US006834526B2

(12) United States Patent
Marx

(10) Patent No.: US 6,834,526 B2
(45) Date of Patent: Dec. 28, 2004

(54) HYDRAULIC DIRECTIONAL CONVERTER

(76) Inventor: Michael Marx, 2660 Northfield, White Lake, MI (US) 48383

( * ) Notice: Subject to any disclaimer, the term of this patent is extended or adjusted under 35 U.S.C. 154(b) by 17 days.

(21) Appl. No.: 10/164,082

(22) Filed: Jun. 5, 2002

(65) Prior Publication Data

US 2002/0184937 A1 Dec. 12, 2002

Related U.S. Application Data

(60) Provisional application No. 60/297,620, filed on Jun. 11, 2001.

(51) Int. Cl.[7] ..... B21D 1/12
(52) U.S. Cl. ..... 72/453.18; 72/705
(58) Field of Search ..... 72/705, 453.18; 60/470, 472

(56) References Cited

U.S. PATENT DOCUMENTS 2,363,235 A * 11/1944 Ellinwood ..... 60/472
4,225,087 A * 9/1980 Lawlor ..... 251/109
5,016,464 A * 5/1991 Tomelleri ..... 72/705
5,257,526 A * 11/1993 Teixeria ..... 72/705

* cited by examiner

*Primary Examiner*—Lowell A. Larson
(74) *Attorney, Agent, or Firm*—Kevin G. Mierzwa

(57) ABSTRACT

A hydraulic system comprises a pump having a fluid feed and a fluid release. Hydraulic actuator has an advance port and a retract port. A directional converter is fluidically coupled between the pump and the hydraulic actuator. The converter has a housing having a plurality of fluid passages therethrough. The plurality of fluid passages terminates in a pump outlet port, a pump inlet port, a first actuator port, and a second actuator port. The pump outlet port is coupled to the fluid release of the pump. The pump inlet port is fluidically coupled to the fluid feed of the pump. The first actuator port and second actuator port are respectively coupled to the advance port and the retract port of the actuator. A plurality of valves is disposed within the fluid passages. The plurality of valves has a first position and a second position. In the first position, a fluid flow direction at the first actuator port is into said housing from the actuator and a second fluid direction and a second actuator port is out of the housing. When the switches are in a second position the fluid flow direction is out of the housing at the second actuator port.

53 Claims, 6 Drawing Sheets

HYDRAULIC DIRECTIONAL CONVERTER

RELATED APPLICATION

The present invention is related to U.S. provisional application No. 60/297,620 entitled "Manual Hydraulic Directional Converter" filed on Jun. 11, 2001, and incorporated by reference herein.

TECHNICAL FIELD

The present invention relates generally to hydraulic actuators, and more specifically, to a directional converter for use with a hydraulic actuator.

BACKGROUND

Frame racks are typically used to straighten the frame of an automotive vehicle after a collision. A frame rack has a deck onto which the vehicle is placed. A number of towers are positioned around the frame rack. The towers have a chain connected thereto that is coupled to a ram. The chains are connected to the frame of the vehicle and the tower is used to pull the chain toward the tower. Typically, the chains are connected to the vehicle so that the vehicle frame is pulled out in the same direction of impact. When the pulling of the frame begins, it is often necessary to adjust the direction of pulling so the pulling force remains in the direction of impact. Oftentimes, this requires the tension to be released from the vehicle, the tower position to be adjusted, and tension placed on the vehicle frame in a slightly different direction. This, however, is a time consuming process and thus increases the expense of the collision repair.

Many frame racks employ a single directional pump. This allows the frame to be pulled in a single direction. Many times both pushing and pulling is desired.

It would therefore be desirable to provide a system for allowing flexibility in the frame straightening process.

SUMMARY OF THE INVENTION

It is therefore one object of the invention to provide a directional converter for a hydraulic actuator that can be easily maneuvered and placed on various positions of a frame rack. The directional converter allows the one-directional fluid flow from a pump to be controlled and reversed. This control allows a hydraulic actuator to be easily positioned and moved to provide pushing and pulling capabilities.

In one aspect of the invention, a directional converter for use with a pump and a hydraulic actuator comprises a housing having a plurality of fluid passages therethrough. The plurality of fluid passages terminates in a pump outlet port, a pump inlet port, a first actuator port, and a second actuator port. A plurality of valves is disposed within the plurality of fluid passages. The plurality of valves has a first position and a second position. In a first position, a fluid flow direction at the first actuator port is into the housing from the actuator, and a fluid flow direction at the second ram port is out of the housing. When the switches are in a second position the first fluid flow direction is out of the housing and the second fluid flow direction is into the housing. The valve positions are preferably set so that two of the valves are open and two of the valves are closed when in operation.

In a further aspect of the invention, a hydraulic system comprises a pump having a fluid feed and a fluid release. Hydraulic actuator has an advance port and a retract port. A directional converter is fluidically coupled between the pump and the hydraulic actuator. The converter has a housing having a plurality of fluid passages therethrough. The plurality of fluid passages terminates in a pump outlet port, a pump inlet port, a first actuator port, and a second actuator port. The pump outlet port is coupled to the fluid release of the pump. The pump inlet port is fluidically coupled to the fluid feed of the pump. The first actuator port and second actuator port are respectively coupled to the advance port and the retract port. A plurality of valves is disposed within the fluid passages. The plurality of valves have a first position and a second position. In the first position, a fluid flow direction at the first actuator port is into the housing from the actuator and a second fluid direction and a second actuator port is out of the housing. When the switches are in a second position the fluid flow direction is out of the housing at the second actuator port.

In a further aspect of the invention, a method of operating a directional converter includes the steps of: providing a pump coupled to an actuator through a converter; actuating a plurality of switches in a first position and a second position; in a first position, flowing hydraulic fluid a first fluid flow direction at a first actuator port into a housing from the actuator and a second fluid flow direction at the second actuator port out of the housing; and when the switches are in a second position, flowing fluid in the first fluid flow direction at the first actuator port out of said housing and second fluid flow direction at said second actuator port into said housing.

One advantage of the invention is that the system may be adapted to use the single direction pump typically found on a frame rack. The system, however, is not limited to the use of the pump on frame rack and may use a stand-alone pump. Likewise, various types of hydraulic actuators may be used with the present invention. The present invention is suitable for various types of actuators in which a reverse flow is useful.

Other advantages and features of the present invention will become apparent when viewed in light of the detailed description of the preferred embodiment when taken in conjunction with the attached drawings and appended claims.

DESCRIPTION OF THE PREFERRED EMBODIMENT

Figure 1:
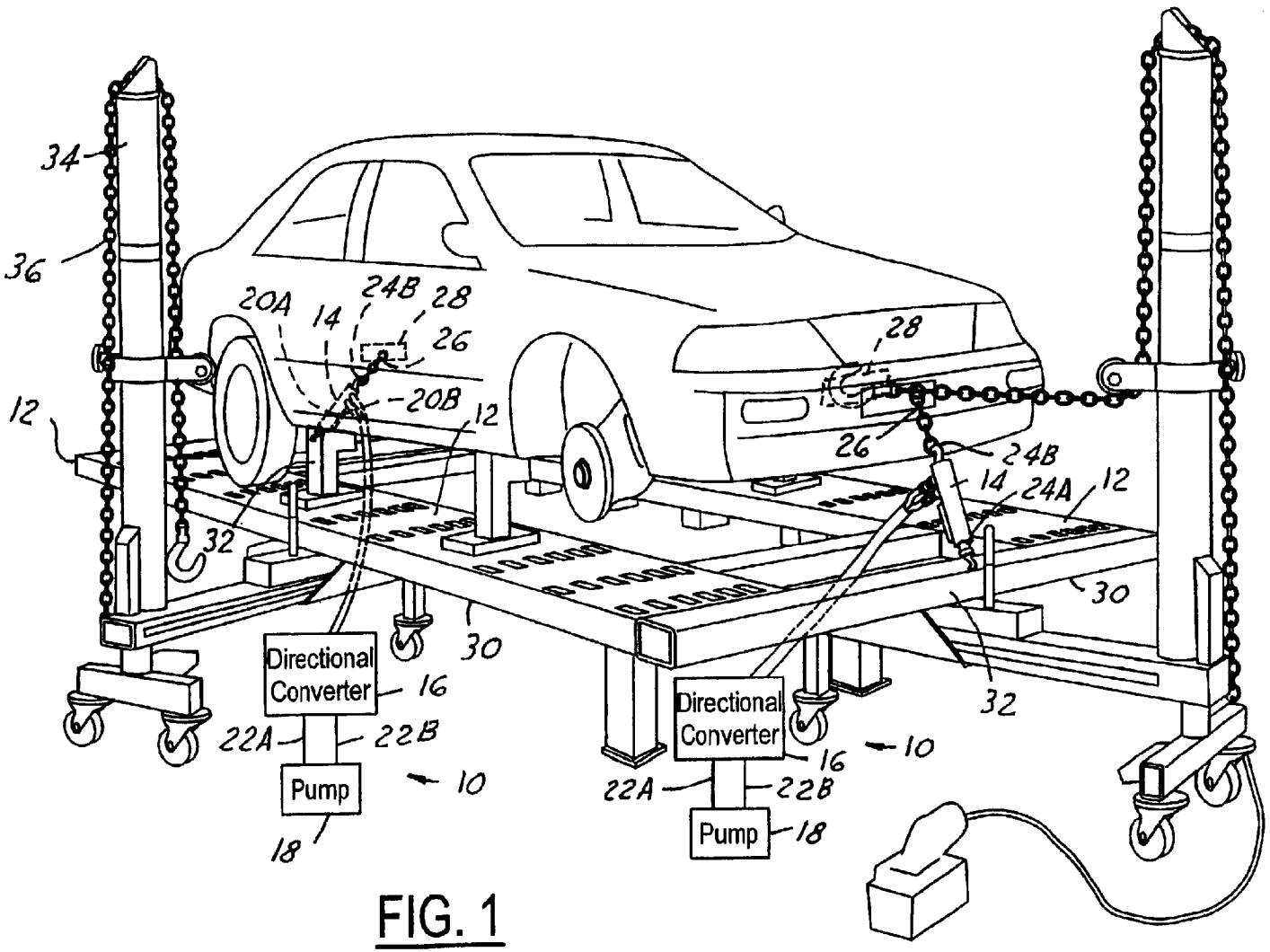
FIG. 1 is a perspective view of an automotive frame rack having a hydraulic system according to the present invention.

In the following figures, the same reference numerals will be used to identify the same components. The following description is set forth with respect to a frame rack for an automotive vehicle. However, the directional converter of the present application has several uses for hydraulic actuators. For example, the directional converter of the present invention may be used in various industries and for devices such as forklifts, manufacturing equipment and other types of equipment using hydraulic actuators such as single direction single release pumps. It should also be noted that any quantities and dimensions are provided for illustrative purposes only and should not be limiting unless set forth in the claims of the present invention.

Referring now to FIG. 1, two hydraulic systems 10 according to the present invention are illustrated. Hydraulic systems 10 are illustrated used on a frame rack 12. As mentioned above, however, the frame rack 12 is merely illustrative of one of the many uses of the present invention. Hydraulic system 10 includes a hydraulic actuator 14, a directional converter 16, and a pump 18. As illustrated, two hoses 20A and 20B, fluidically couple directional converter 16 and hydraulic actuator 14. Also, two hoses 22A and 22B fluidically couple directional converter 16 and pump 18. Hydraulic actuator 14 may have a mechanical coupling device such as a pair of claw hooks 24. It should be noted that in various applications claw hooks 24A and 24B may be substituted with other mechanical fastening devices such as bolt down components, loops or stays. Claw hook 24B is illustrated mechanically coupled to a chain 26, which in turn is coupled to a portion of a frame 28 of an automotive vehicle.

Frame rack 12 has a deck 30 for positioning a vehicle thereon. Deck 30 may have openings or tie down holes 32 positioned therein to receive claw hook 24 or other mechanical securing means for hydraulic actuator 14. Frame rack 12 may also include various towers 34 that include a ram 36 and a chain 38. Of course, different numbers of towers 34 may be used on a frame rack.

Figure 2:
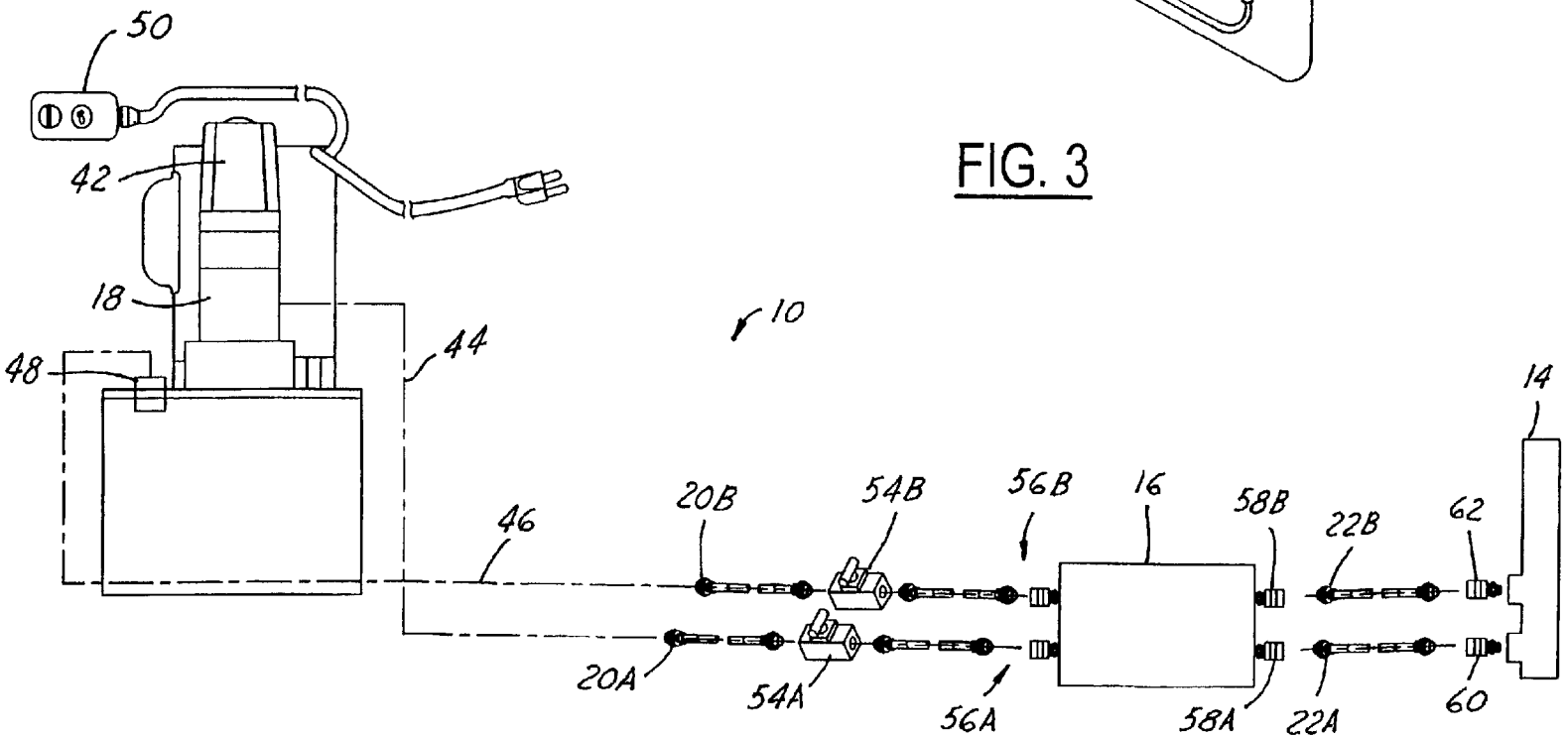
FIG. 2 is an exploded view of a hydraulic system according to the present invention.

Referring now to FIG. 2, hydraulic system 10 is illustrated in further detail. Hydraulic pump 18 may be a stand-alone pump as mentioned below in FIG. 3 or may be a pump that is integrated into the rack system. Pump 18 has a pump reservoir 40 for storing hydraulic fluid therein. Pump 18 has an electric motor 42 coupled thereto to generate pressure in hydraulic fluid passing from the pump. Pump 18 has a feed line 44 that delivers high pressure fluid to directional converter 16. Reservoir 40 has a return line or release line 46 that returns the hydraulic fluid to pump reservoir 40 through a breathable coupler 48. Pump 18 may be operated using a switch 50 that is coupled to a motor within the pump housing.

Line valves 54A and 54B may facilitate the connection or disconnection of the hoses 20A and 20B. Line valves are an optional feature.

Line valves 54A and 54B may be coupled to respective feed line 44 and release line 46. Quick couplers 56A and 56B may be coupled to respective feed line 44 and release line 46 to easily couple feed line 44 and release line 46 to directional converter 16. For example, quick couplers 46A and 46B may have a male portion or female portion coupled to feed line 44 and release line 46 while directional converter 46 may have the opposite portion of quick coupler 56A, 56B attached thereto. Quick couplers 58A and 58B may also be used to couple actuator 14 to directional converter 16. Quick couplings may also be used to attach hoses 22A, 22B to actuator 14.

Actuator 14, as mentioned above, is preferably a hydraulic ram. More specifically, actuator 14 is preferably a directional actuator having an advance port 60 and a retract port 62. By controlling the direction of fluid through directional converter 16, the actuator 14 may advance and retract (push and pull) accordingly. That is, force may be applied in both directions as opposed to a single direction device which can only pull with force but cannot push or vice versa. Directional converter 60 is used to change the direction of fluid flow to actuator 14 so that the fluid leaving directional converter causes the motion of actuator 14.

Figure 3:
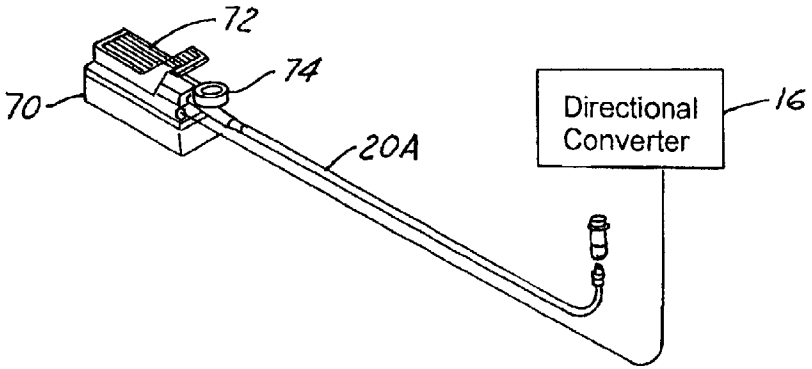
FIG. 3 is a perspective view of an alternative embodiment of a stand-alone pump hydraulic system according to the present invention.

Referring now to FIG. 3, a stand-alone pump 70 is illustrated. Stand-alone pump 70 may have a foot pedal 72 to control the operation thereof. Stand-alone pump 70 has hoses 20A and 20B coupled thereto in a similar manner to that shown above. Stand alone pump 70 is a single direction pump. The feed hose 20A may have a pressure gauge 74 thereon to monitor the pressure of the hydraulic pump.

Figure 4:
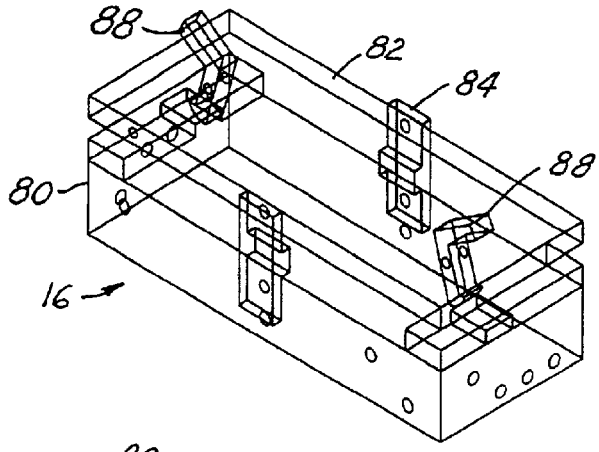
FIG. 4 is a perspective view of the directional converter according to the present invention.
Figure 5:
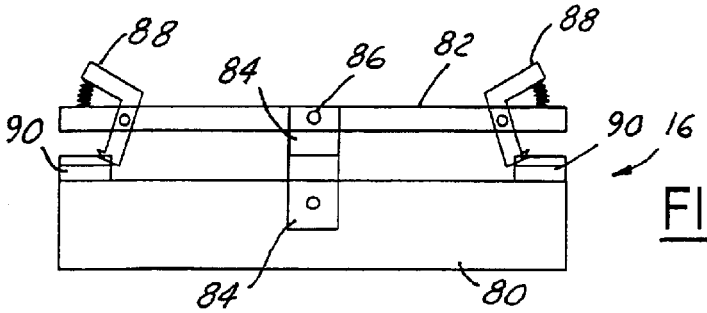
FIG. 5 is a side view of the directional converter of FIG. 4.

Referring now to FIGS. 4 and 5, a first embodiment of a directional converter 16 is illustrated in further detail. Directional converter 16 has a housing 80 and a foot pedal 82 that is pivotably attached thereto. A pair of pedal hinges 84 attached through a pedal pin 86 is used to pivot the foot pedal 82 about the pedal pin 86. A lock 88 may be located on each side of pedal 82. Lock 88 is used to engage a catch 90 positioned on housing 80. Catches 90 engage lock 88 to maintain the pedal 82 in a pivoted position. As illustrated, lock 88 extends through pedal 82. However, various types of locks may be evident to those skilled in the art.

Figure 6:
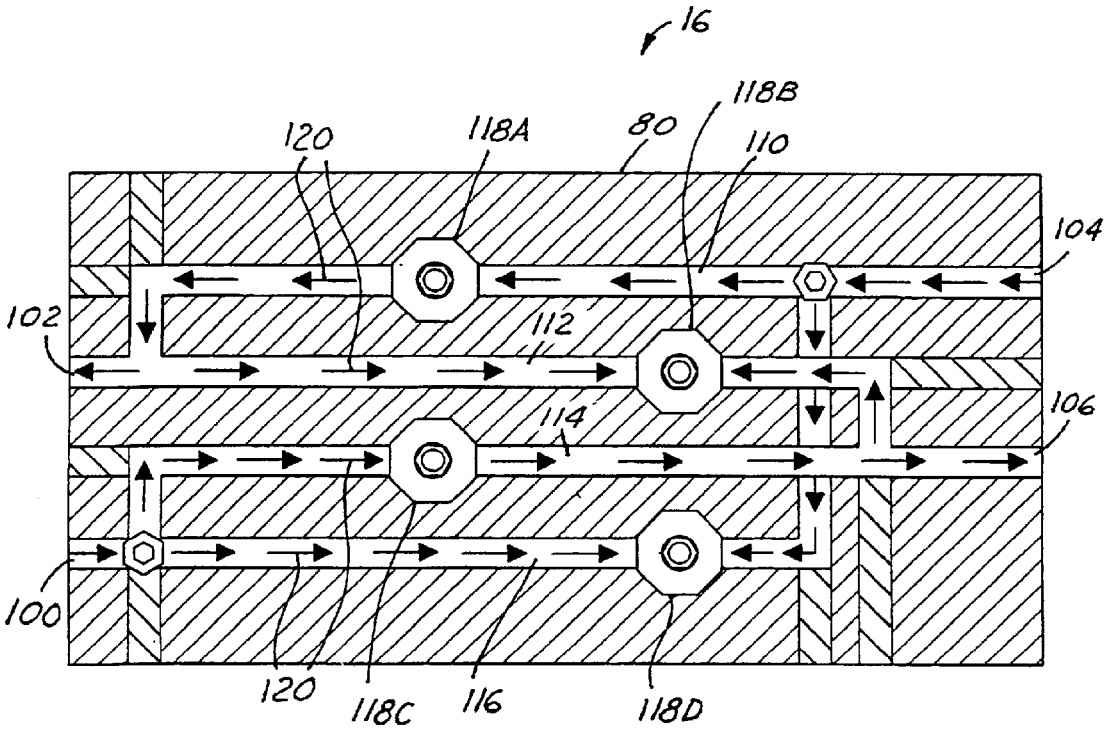
FIG. 6 is a cross-sectional view of the directional converter of FIGS. 4 and 5 showing the fluid passages in a cylinder up direction.

Referring now to FIG. 6, a cutaway view of housing 80 is illustrated in further detail. Housing 80 has a plurality of ports that are coupled to the pump and to the actuator. Preferably, four ports are provided. The ports include a pump outlet port 100, a pump inlet port 102, a first actuator port 104, and a second actuator port 106.

A plurality of fluid passages is provided between pump outlet port 100, pump inlet port 102, first actuator port 104, and second actuator port 106. As Illustrated, four fluid passages are illustrated. A first fluid passage 110 is coupled between pump inlet port 102 and first actuator port 104. A second fluid passage 112 is coupled between pump inlet port 102 and second actuator port 106. A third fluid passage 114 is fluidically coupled between the pump outlet port 100 and the first actuator port 104. A fourth fluid passage 116 is fluidically coupled between the pump outlet port 100 and the first actuator port 104. Pump outlet port 100 and pump inlet port 102 are located on a first face 101 of the housing 80. First actuator port 104, and second actuator port 106 are located on a second face of housing 105. The first face 101 and second face 105 are on opposite sides of the housing 80 from one another. As is illustrated the faces 101, 105 may be parallel to one another.

Each of the fluid passages 110, 112, 114, and 116 has a respective valve 118A–118D therein. Preferably, valves are normally closed valves. Valves 118 may be manually operated such as by foot pedal 82 above. Upon the application of pressure to the top portion of valve 118, the valve may open to allow fluid through the respective passage. In this figure, valves 118A and 118C are open and valves 118B and 118D are closed. This is referred to as a plurality of valves having a first position. The fluid flow is illustrated by arrows 120. This configuration corresponds to moving actuator up or outward. In the first fluid passage, fluid is returned from the actuator through first actuator port 104, which is coupled to the pump inlet port 102, which in turn is fluidically coupled to the reservoir of the pump. Fluid is provided to the actuator from the pump through pump outlet port 100 and is transferred through third fluid passage 114 to second actuator port 106. Because valves 118B and 118D are closed, no fluid flows through second fluid passage 112 and fourth fluid passage 116.

Figure 7:
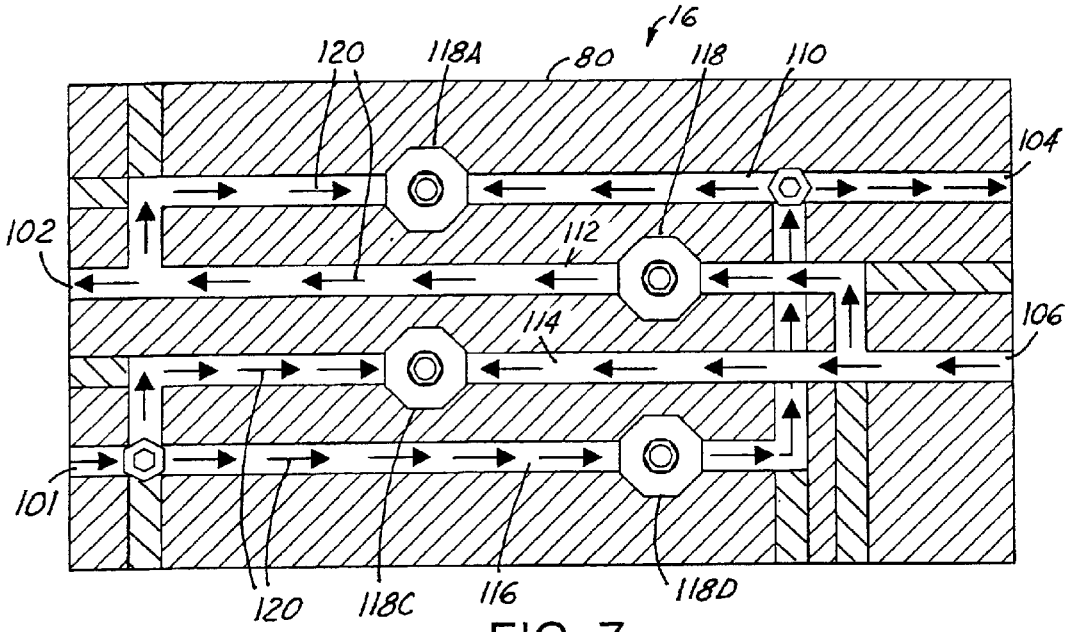
FIG. 7 is a cross-sectional view of the directional converter of FIGS. 4 and 5 showing the fluid passages in a cylinder down direction.

Referring now to FIG. 7, the position of valves 118A–118D may be referred to as the plurality of valves being in a second position. That is, valves 118A and 118C are now closed while valves 118B and 118D are open. In this manner, fluid flows from second actuator port 106 through valve 118B to pump inlet port 102. Fluid flows from pump outlet port 100 through valve 118D to first actuator port 104. This configuration corresponds to retracting the actuator.

Figure 8:
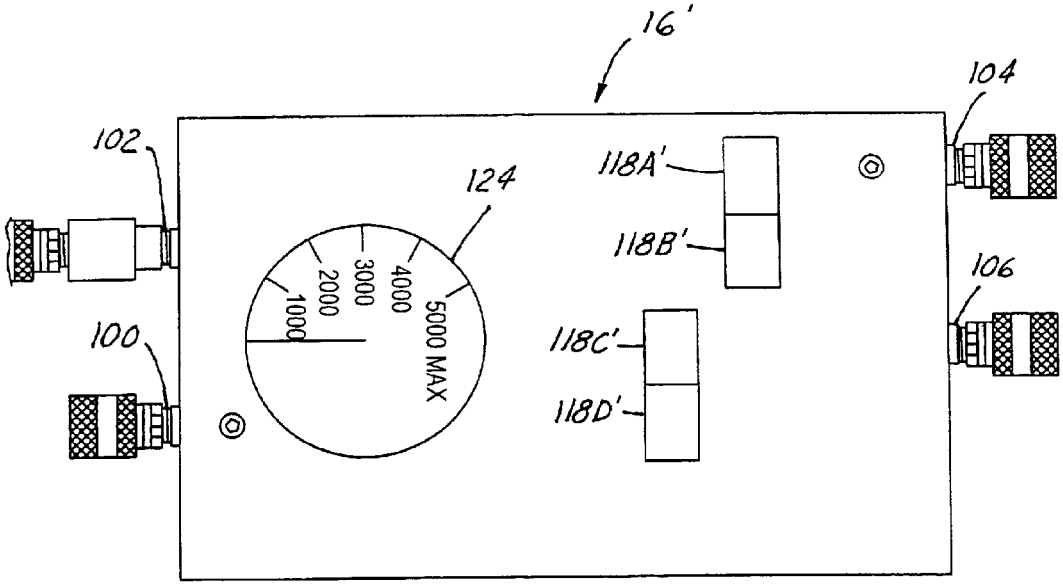
FIG. 8 is an alternative configuration of a directional converter according to a second embodiment of the invention.
Figure 9:
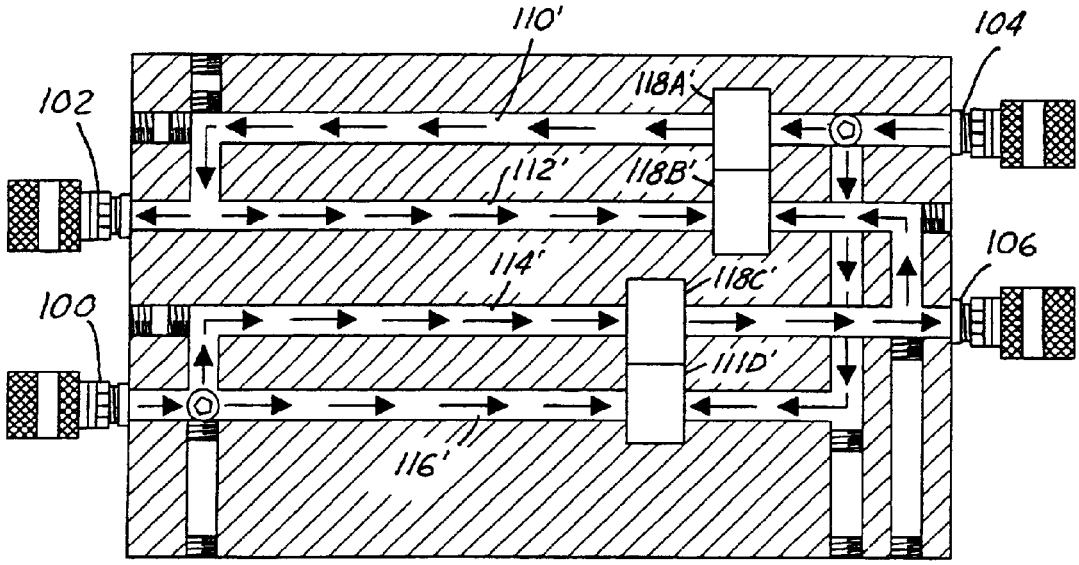
FIG. 9 is a cross-sectional view illustrating the fluid passages of the embodiment of FIG. 8 in a cylinder up configuration.
Figure 10:
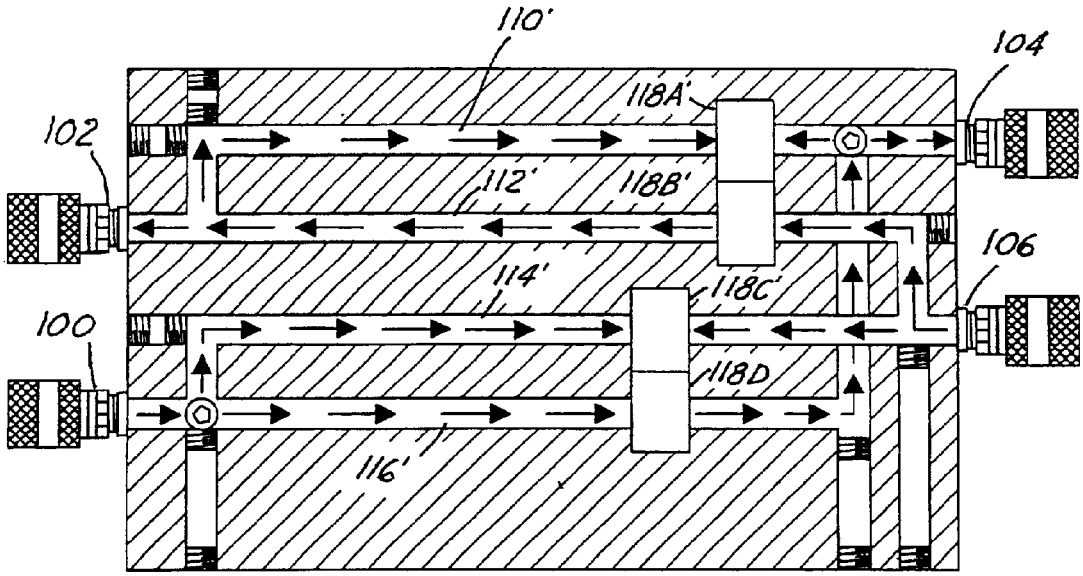
FIG. 10 is a cross-sectional view illustrating the fluid passages of the embodiment of FIG. 8 in a cylinder down configuration.

Referring now to FIG. 8, a second embodiment of directional converter 16' is illustrated. Directional converter 16' in this embodiment has a pressure gauge 124 that is fluidically coupled to pump outlet port 100 to measure the hydraulic fluid from the pump. In this embodiment valves 118A', 118B', 118C', and 118D' have been located in slightly different positions than those of valves 118A–118D shown in FIGS. 6 and 7 but still in the same passages. Valves 118A'–118D' in this embodiment may be hand operated rather than operated by a foot pedal 82 shown above. The operation of FIGS. 9 and 10 is similar to that of FIGS. 6 and 7 in that the fluid flows through the directional converter 16' in a similar manner.

Figure 11:
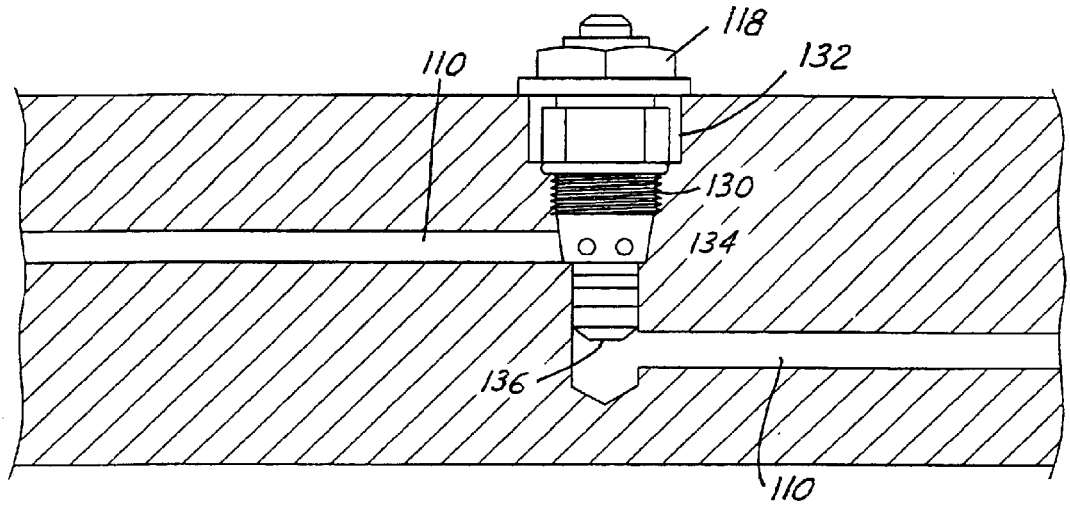
FIG. 11 is a side cross-sectional view of a typical valve within a fluid passage according to the present invention.

Referring now to FIG. 11, a typical valve 118 is illustrated in further detail. To facilitate assembly, valve 118 has threads 130 thereon which may be used to secure valves 118 within an opening 132. As is illustrated, the fluid passages may be in more than one plane but generally each has a longitudinal passage direction that is parallel to the other passages. Fluid passes through the valve 118 when it is opened through valve ports 134 which in turn allow the fluid to flow through a bottom portion 136 of valve 118. The valves 118 are disposed in a direction that is perpendicular to the longitudinal passage direction. If the valves have a turn or bend the longitudinal direction is the direction of the passages adjacent to the valves.

Figure 12:
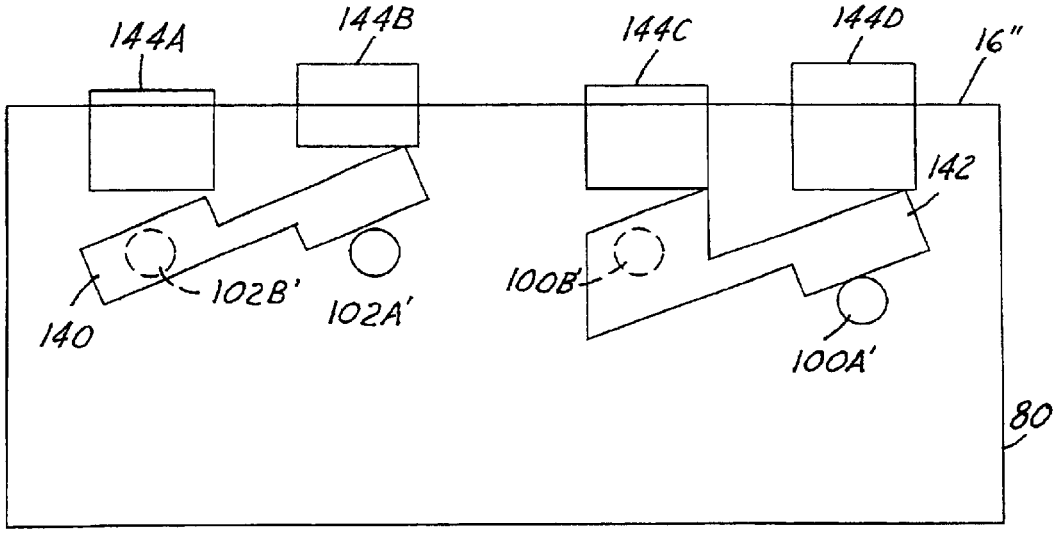
FIG. 12 is a side view of an alternative switch/valve configuration for the valve of the present invention.

Referring now to FIG. 12, a third alternative embodiment of directional converter 16" is illustrated. In this embodiment, a pair of rocker switches 140 and 142 is actuated by push buttons 144A, 144B, 144C, and 144D. In this embodiment the side view of housing is illustrated. In this embodiment, two ports per pump outlet port may be utilized. These ports are labeled as 100A' and 100B'. Likewise, two pump inlet ports 102A' and 102B' are illustrated. By moving the position of rocker switches 140 and 142, different fluid passages may be coupled to the pump, which can result in the change of movement of the housing through block 80. Rocker switches may also be provided on the opposite side of block corresponding to the first actuator port and the second actuator ports.

As can be seen, a one directional pump may be used in two directions and thus allow the flexibility in such applications as frame rack applications.

While particular embodiments of the invention have been shown and described, numerous variations and alternate embodiments will occur to those skilled in the art. Accordingly, it is intended that the invention be limited only in terms of the appended claims.

What is claimed is:

1. A directional converter for use with a pump and a hydraulic actuator having an advance and retract ports comprising:

a housing having a plurality of fluid passages having a passage direction therethrough, said plurality of passages terminating in a pump outlet port, a pump inlet port, a first actuator port and a second actuator port; and a plurality of valves disposed within and perpendicularly to the passage direction of said plurality of fluid passages, said plurality of valves having a first position and a second position, wherein in a first position a first fluid flow direction at the first actuator port is into said housing from the actuator and a second fluid flow direction at the second actuator port is out of the housing and when the valves are in a second position the first fluid flow direction at the first actuator port is out of said housing and second fluid flow direction at said second actuator port is into said housing.

2. A directional converter as recited in claim 1 wherein the plurality of valves comprises a plurality of normally closed valves.

3. A directional converter as recited in claim 1 further comprising a foot pedal, wherein said foot pedal is operably coupled to said plurality of valves.

4. A directional converter as recited in claim 1 wherein the plurality of fluid passages comprises a first fluid passage fluidically coupled between the pump inlet port and the first actuator port.

5. A directional converter as recited in claim 1 wherein the plurality of fluid passages comprises a second fluid passage fluidically coupled between the pump inlet port and the second actuator port.

6. A directional converter as recited in claim 1 wherein the plurality of fluid passages comprises a third fluid passage fluidically coupled between the pump outlet port and the second actuator port.

7. A directional converter as recited in claim 1 wherein the plurality of fluid passages comprises a fourth fluid passage fluidically coupled between the pump outlet port and the first actuator port.

8. A directional converter as recited in claim 1 further comprising a foot pedal operably coupled to the plurality of valves.

9. A directional converter as recited in claim 8 further comprising a lock operably coupled between said pedal and said housing.

10. A directional convertor as recited in claim 1 wherein said pump outlet port and said pump inlet port is disposed on a first face of the housing and said first actuator port and said second actuator port are disposed on a second face of the housing opposite the first face.

11. A directional converter for use between a pump and a hydraulic actuator having an advance port and a retract port comprising:

a housing having a first fluid passage fluidically coupled between a pump inlet port and a first actuator port, a second fluid passage fluidically coupled between the pump inlet port and a second actuator port, a third fluid passage fluidically coupled between a pump outlet port and the second actuator port, and a fourth fluid passage fluidically coupled between the pump outlet port and the first actuator port said first fluid passage, said second fluid passage, said third fluid passage and said fourth fluid passage having a passage direction;

a first valve disposed within said first fluid passage perpendicular to said passage direction, said first valve selectively fluidically coupling said pump inlet port and first actuator port;

a second valve disposed within said second fluid passage perpendicular to said passage direction, said second valve selectively fluidically coupling said pump inlet port and said second actuator port;

a third valve disposed within said third fluid passage perpendicular to said passage direction, said third valve selectively fluidically coupling said pump outlet port and said second actuator port; and a fourth valve disposed within said fourth fluid passage perpendicular to said passage direction, said fourth valve selectively fluidically coupling the pump outlet port and the first actuator port.

12. A directional converter as recited in claim 11 wherein said first valve, said second valve, said third valve, and said fourth valve are normally closed.

13. A directional converter as recited in claim 11 further comprising a foot pedal operably coupled to the first valve, the second valve, the third valve and the fourth valve.

14. A directional converter as recited in claim 11 further comprising a lock operably coupled between a pedal and said housing.

15. A hydraulic actuator system comprising:

a pump having a fluid feed and a fluid release;

a hydraulic actuator having an advance port and a retract port;

a directional converter fluidically coupled between said pump and said hydraulic actuator, said directional converter comprising, a housing having a plurality of fluid passages therethrough, said plurality of passages terminating in a pump outlet port, a pump inlet port, a first actuator port and a second actuator port, said passages having a passage direction; and a plurality of valves disposed within said plurality fluid passages perpendicular to said passage direction, said plurality of valves having a first position and a second position, wherein in a first position a first fluid flow direction at the first actuator port is into said housing from the actuator and a second fluid flow direction at the second actuator port is out of the housing and when the plurality of valves are in a second position the first fluid flow direction at the first actuator port is out of said housing and second fluid flow direction at said second actuator port is into said housing.

16. A hydraulic actuator system as recited in claim 15 wherein the pump is a single directional pump.

17. A hydraulic actuator system as recited in claim 15 wherein the actuator comprises a two-way ram.

18. A hydraulic actuator system as recited in claim 15 wherein the plurality of valves comprise a plurality of normally closed valves.

19. A hydraulic actuator system as recited in claim 15 further comprising a foot pedal, wherein said foot pedal is operably coupled to said plurality of valves.

20. A hydraulic actuator system as recited in claim 15 wherein the plurality of fluid passages comprises a first fluid passage fluidically coupled between the pump inlet port and the first actuator port.

21. A hydraulic actuator system as recited in claim 15 wherein the plurality of fluid passages comprises a second fluid passage fluidically coupled between the pump inlet port and the second actuator port.

22. A hydraulic actuator system as recited in claim 15 wherein the plurality of fluid passages comprises a third fluid passage fluidically coupled between the pump outlet port and the second actuator port.

23. A hydraulic actuator system as recited in claim 15 wherein the plurality of fluid passages comprises a fourth fluid passage fluidically coupled between the pump outlet port and the first actuator port.

24. A hydraulic actuator system as recited in claim 15 further comprising a foot pedal operably coupled to the plurality of valves.

25. A hydraulic actuator system as recited in claim 24 further comprising a lock operably coupled between said pedal and said housing.

26. A frame rack system comprising:

a rack deck;

a pump;

a hydraulic actuator coupled to said rack deck;

a directional converter fluidically coupled between said pump and said hydraulic actuator, said direction converter comprises:

a housing having a plurality of fluid passages therethrough, said passages having a passage direction, said plurality of passages terminating in a pump outlet port, a pump inlet port, a first actuator port and a second actuator port; and a plurality of valves disposed within said plurality fluid passages, said valves oriented perpendicular to the passage direction, said plurality of valves having a first position and a second position, wherein in a first position a first fluid flow direction at the first actuator port is into said housing from the actuator and a second fluid flow direction at the second actuator port is out of the housing and when the plurality of valves are in a second position the first fluid flow direction at the first actuator port is out of said housing and second fluid flow direction at said second actuator port is into said housing.

27. A frame rack system as recited in claim 26 wherein the pump is integrated into the rack.

28. A frame rack system as recited in claim 26 wherein in the pump is a separate from the actuator rack.

29. A frame rack system as recited in claim 26 wherein the pump comprises a foot-operated pump.

30. A frame rack system as recited in claim 26 wherein the pump is a single directional pump.

31. A frame rack system as recited in claim 26 wherein the actuator comprises a two-way ram.

32. A frame rack system as recited in claim 26 wherein the plurality of valves comprise a plurality of normally closed valves.

33. A frame rack system as recited in claim 26 further comprising a foot pedal, wherein said foot pedal is operably coupled to said plurality of valves.

34. A frame rack system as recited in claim 26 wherein the plurality of fluid passages comprises a first fluid passage fluidically coupled between the pump inlet port and the first actuator port.

35. A frame rack system as recited in claim 26 wherein the plurality of fluid passages comprises a second fluid passage fluidically coupled between the pump inlet port and the second actuator port.

36. A frame rack system as recited in claim 26 wherein the plurality of fluid passages comprises a third fluid passage fluidically coupled between the pump outlet port and the second actuator port.

37. A frame rack system as recited in claim 26 wherein the plurality of fluid passages comprises a fourth fluid passage fluidically coupled between the pump outlet port and the first actuator port.

38. A frame rack system as recited in claim 26 further comprising a foot pedal operably coupled to the plurality of valves.

39. A frame rack system as recited in claim 38 further comprising a lock operably coupled between said pedal and said housing.

40. A method for operating a hydraulic actuator comprising:

providing a pump coupled to an actuator through a converter;

actuating a plurality of switches in a first position and a second position;

actuating valves oriented perpendicular to a plurality of fluid passages with the plurality of switches;

in a first position, flowing hydraulic fluid a first fluid flow direction at a first actuator port into a housing from the actuator and a second fluid flow direction at the second actuator port out of the housing; and when the switches are in a second position, flowing fluid in the first fluid flow direction at the first actuator port out of said housing and second fluid flow direction at said second actuator port into said housing.

41. A method as recited in claim 40 further comprising extending the actuator in response to the switches in the first position.

42. A method as recited in claim 40 further comprising retracting an actuator when the switch is in the second position.

43. A directional converter for use with a pump and a hydraulic actuator having an advance and retract ports comprising:

a housing having a plurality of fluid passages therethrough, said plurality of passages terminating in a pump outlet port and a pump inlet port disposed on a first face of the housing, and a first actuator port and a second actuator port disposed on a second face of the housing opposite the first face; and a plurality of valves disposed within said plurality fluid passages, said plurality of valves having a first position and a second position, wherein in a first position a first fluid flow direction at the first actuator port is into said housing from the actuator and a second fluid flow direction at the second actuator port is out of the housing and when the valves are in a second position the first fluid flow direction at the first actuator port is out of said housing and second fluid flow direction at said second actuator port is into said housing.

44. A directional converter as recited in claim 43 wherein the plurality of valves comprises a plurality of normally closed valves.

45. A directional converter as recited in claim 43 further comprising a foot pedal, wherein said foot pedal is operably coupled to said plurality of valves.

46. A directional converter as recited in claim 43 wherein the plurality of fluid passages comprises a first fluid passage fluidically coupled between the pump inlet port and the first actuator port, a second fluid passage fluidically coupled between the pump inlet port and the second actuator port, a third fluid passage fluidically coupled between the pump outlet port and the second actuator port, and a fourth fluid passage fluidically coupled between the pump outlet port and the first actuator port.

47. A directional converter as recited in claim 43 further comprising a foot pedal operably coupled to the plurality of valves.

48. A directional converter as recited in claim 43 further comprising a lock operably coupled between said pedal and said housing.

49. A hydraulic actuator system comprising:

a pump having a fluid feed and a fluid release;

a hydraulic actuator having an advance port and a retract port;

a directional converter fluidically coupled between said pump and said hydraulic actuator, said directional converter comprising, a housing having a plurality of fluid passages therethrough, said plurality of passages terminating in a pump inlet port and a pump outlet port disposed on a first face of the housing, and a first actuator port and a second actuator port disposed on a first face of the housing opposite the first face; and a plurality of valves disposed within said plurality fluid, said plurality of valves having a first position and a second position, wherein in a first position a first fluid flow direction at the first actuator port is into said housing from the actuator and a second fluid flow direction at the second actuator port is out of the housing and when the plurality of valves are in a second position the first fluid flow direction at the first actuator port is out of said housing and second fluid flow direction at said second actuator port is into said housing.

50. A hydraulic actuator system as recited in claim 49 further comprising a foot pedal operably coupled to the plurality of valves.

51. A frame rack system comprising:

a rack deck;

a pump;

a hydraulic actuator coupled to said rack deck;

a directional converter fluidically coupled between said pump and said hydraulic actuator, said direction convertor comprises:

a housing having a plurality of fluid passages therethrough, said plurality of passages terminating in a pump inlet port and pump outlet port disposed on a first face of the housing, and a first actuator port and a second actuator port disposed on a second face of the housing opposite the first face; and a plurality of valves disposed within said plurality fluid passages, said plurality of valves having a first position and a second position, wherein in a first position a first fluid flow direction at the first actuator port is into said housing from the actuator and a second fluid flow direction at the second actuator port is out of the housing and when the plurality of valves are in a second position the first fluid flow direction at the first actuator port is out of said housing and second fluid flow direction at said second actuator port is into said housing.

52. A frame rack system as recited in claim 49 further comprising a foot pedal operably coupled to the plurality of valves.

53. A hydraulic actuator system comprising:

a single direction pump having a fluid feed and a fluid release;

a hydraulic actuator having an advance port and a retract port;

a directional converter fluidically coupled between said pump and said hydraulic actuator, said directional converter comprising, a housing having a plurality of fluid passages therethrough, said plurality of passages terminating in a pump outlet port, a pump inlet port, a first actuator port and a second actuator port;

a pedal coupled to said housing; and a plurality of valves disposed within said plurality fluid passages and extending from a face of said housing, said pedal operably coupled to said plurality of valves, said plurality of valves and said pedal having a first position and a second position, wherein in a first position a first fluid flow direction at the first actuator port is into said housing from the actuator and a second fluid flow direction at the second actuator port is out of the housing and when the plurality of valves are in a second position, the first fluid flow direction at the first actuator port is out of said housing and second fluid flow direction at said second actuator port is into said housing.

* * * * *

UNITED STATES PATENT AND TRADEMARK OFFICE

CERTIFICATE OF CORRECTION

PATENT NO. : 6,834,526 B2
DATED : December 28, 2004
INVENTOR(S) : Michael Marx

It is certified that error appears in the above-identified patent and that said Letters Patent is hereby corrected as shown below:

Column 7,
Line 41, should read as follows: -- a plurality of valves disposed within said plurality of fluid --

Column 8,
Line 28, should read as follows: -- a plurality of valves disposed within said plurality of fluid --
Line 43, should read as follows: -- the pump is separate from the actuator rack. --

Column 9,
Line 43, should read as follows: -- a plurality of valves disposed within said plurality of fluid --

Column 10,
Line 19, should read as follows: -- a plurality of valves disposed within said plurality of fluid passages, --
Line 46, should read as follows: -- a plurality of valves disposed within said plurality of fluid --

Column 11,
Line 6, should read as follows: -- a plurality of valves disposed within said plurality of fluid --

Signed and Sealed this

Tenth Day of May, 2005

JON W. DUDAS
*Director of the United States Patent and Trademark Office*